US006948797B2

(12) United States Patent
Shepherd et al.

(10) Patent No.: US 6,948,797 B2
(45) Date of Patent: Sep. 27, 2005

(54) NON-UNIFORM PASSES PER RASTER

(76) Inventors: Matthew A. Shepherd, 3201 NE. 165th Ave., Vancouver, WA (US) 98682; Marc Yousey, 210 NW. 20th Ave., #306, Portland, OR (US) 97209; Jason M. Quintana, 20312 NE. 139th St., Brush Prairie, WA (US) 98606; Dawn Beachnau Hood, 5245 NE. 14th Pl., Portland, OR (US) 97211

( * ) Notice: Subject to any disclaimer, the term of this patent is extended or adjusted under 35 U.S.C. 154(b) by 0 days.

(21) Appl. No.: 10/616,618

(22) Filed: Jul. 10, 2003

(65) Prior Publication Data

US 2005/0007414 A1 Jan. 13, 2005

(51) Int. Cl.[7] ..... B41J 2/145
(52) U.S. Cl. ..... 347/41
(58) Field of Search ..... 347/41, 12, 15, 347/40, 37, 43; 358/502

(56) References Cited

U.S. PATENT DOCUMENTS

| | | | | |
|---|---|---|---|---|
| 5,790,150 | A | 8/1998 | Lidke et al. | |
| 6,145,959 | A | 11/2000 | Lund et al. | |
| 6,209,987 | B1 * | 4/2001 | Katayama | 347/43 |
| 6,286,926 | B1 | 9/2001 | Hirabayashi et al. | |
| 6,533,393 | B1 | 3/2003 | Meyer et al. | |
| 2002/0001098 | A1 | 1/2002 | Moriyama et al. | |

FOREIGN PATENT DOCUMENTS

| | | |
|---|---|---|
| EP | 1029693 | 8/2000 |

* cited by examiner

*Primary Examiner*—Lamson Nguyen

(57) ABSTRACT

Systems, methods and devices are provided for non-uniform passes per raster printing. In one embodiment, a printing method includes receiving a print job. The method further includes performing the print job. Performing the print job includes printing non-uniform passes per raster in a contiguous vertical block of rasters.

22 Claims, 10 Drawing Sheets

804-1 802

Adverto Populi:

804-2

Capiunt ergone te caelum et terra, quoniam tu imples ea? an imples et restat, quoniam non te capiunt? et quo refundis quidquid impleto caeloet terra restat ex te? 804-3

Hanc ergo aetatem, domine, qua me vixisse memini 804-4

Nonne ab infantia huc pergens vel potius ipsa signa 804-5

804-6

Et tamen peccabam, domine deus meus, ordinator et creator rerum omnium naturalium, peccatorum autem tantum ordinator, domine deus meus, peccabam faciendo contra praecepta parentum et magistrorum 804-7

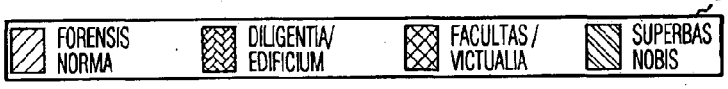

804-8

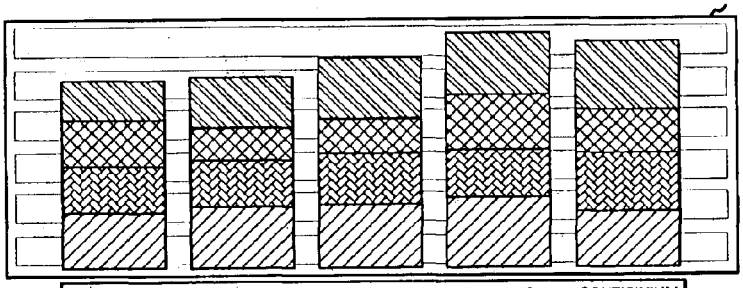

CONTICINIUM 1991 | SECUNDUS 1991 | TERTIUS 1991 | QUARTUS 1991 | CONTICINIUM 1992 804-9

804-10

Quid autem erat causae, cur graecas litteras oderam, quibus puerulus imbuebar, ne nunc quidem mihi satis exploratum est. adamaveram enim latinas, non quas primi magistri, sed quas docent qui grammatici vocantur.

804-11

Quid enim miserius misero non miserante se ipsum et flente Didonis mortem, quae fiebat amando Aenean, non flente autem mortem suam, quae fiebat non amando te, deus, lumen cordis mei et panis oris intus.

804-N

In ipsa tamen pueritia, de qua mihi minus quam de adulescentia metuebatur, non amabam litteras et me in eas urgeri oderam.

*Fig. 8*

NON-UNIFORM PASSES PER RASTER

One or more printheads for different color inks may be contained in a print cartridge, which may either contain the supply of ink for each printhead or be connected to an ink supply located off-cartridge. Cartridges are mounted in a carriage which traverses, or scans, the cartridges across media during printing such that the ink can be applied to given printing locations, called pixels.

Each printhead has an arrangement of nozzles through which ink drops are controllably ejected onto the print media. The nozzles are arranged in an array of vertical columns and horizontal rows. The vertical DPI (dots per inch) of a given printhead is the pitch of dots that a printhead can print in a single printhead scan. The particular combination of scans, ink drop emission during each scan, and the amount and timing of the media advance used to print on the media is generally referred to as a "print mode".

Independent of the vertical and horizontal DPI of the printhead, for a given media and quality selected in a printer driver, data is represented to be printed at a different horizontal and vertical DPI. This "data resolution" can be below, at, or above the horizontal/vertical DPI of the individual scans that will be used to print the data. Each horizontal row in the data is termed to be a raster, such that the pitch of the rasters is the vertical DPI of the data. This concept applies to when the vertical DPI of the rasters is above (not at or below) the vertical DPI of the printhead scan.

Contiguous vertical blocks of rasters can be referred to as a region. A given contiguous vertical region, or block, of rasters is completed in a single print mode. All of the data, having a single print mode algorithm, is completed for a particular region before the print mode is changed. Thus, all rasters in a contiguous vertical block of rasters get the same uniform number of physical passes by a nozzle. The nozzle passes are integer multiples of the minimum number of passes used to print all of the rasters.

BRIEF DESCRIPTION OF THE DRAWINGS

FIG. 8 illustrates an embodiment of a document separated into contiguous print regions.

DETAILED DESCRIPTION

In order to form high quality text and images on the media, multiple passes of a printhead arrangement can be employed either to: (1) print all of the rasters of the data when the printhead is below the data resolution, (2) make multiple drops per data location, and/or (3) to hide errors using redundancy to fully print all the pixels of an individual region.

As an example of (1), a print job may be received with a data resolution of 600 horizontal and vertical DPI. The print mode may be set to 600 horizontal DPI (e.g. plain print mode), but the printhead may physically have only a 300 vertical DPI capability. In this case, at least two scans per region of the page will be made since a single scan can only place dots at half of the vertical positions.

A variety of data resolutions exist depending on the media and quality that a user selects. And, existing printing devices can be set to a variety of print modes. However, the printhead has a fixed vertical resolution. Thus, the minimum number of physical printhead passes per contiguous vertical region, or block, of rasters is equal to the vertical data resolution DPI divided by the printhead resolution DPI.

As another example, a printing device may print from 1200 DPI data, and have a print mode set to 600 horizontal, but the printhead may physically have only a 300 vertical DPI capability. A given contiguous vertical region of rasters is completed in a single print mode. In this case, at least four raster scans are used to achieve the 1200 vertical DPI data since a single scan can only place dots at a quarter of the vertical positions. And, in this example, at least two scans per horizontal raster line are used in the region in order to achieve the 1200 horizontal DPI data since a single scan can only place dots at half of the horizontal positions. Existing print mode algorithms start and complete a given contiguous vertical block of rasters. Thus, in total, eight (8) physical printhead passes will be made.

One factor considered by purchasers of inkjet printers is the speed at which a page of information can be printed, which in turn relates to the throughput, or the number of pages that can be printed in a given amount of time. Speed and throughput depend upon a number of factors. One factor is the number of times that the printhead arrangement scans an individual region in order to print all the pixels in the region—the more scans performed, the longer the printing time. As stated above, the number of scans performed depends on the type of information (resolution data, print mode, etc.) contained in the region.

Figure 1A:
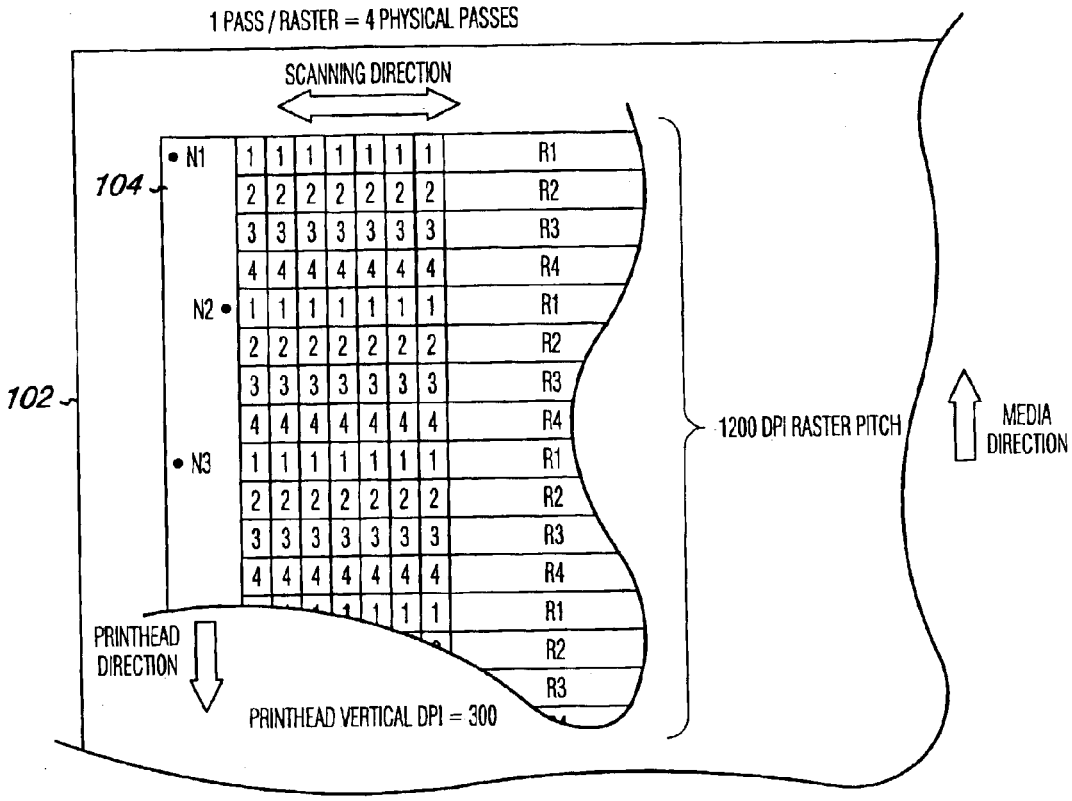
FIGS. 1A–1C illustrate printing approaches using a single print mode in a region.
Figure 1B:
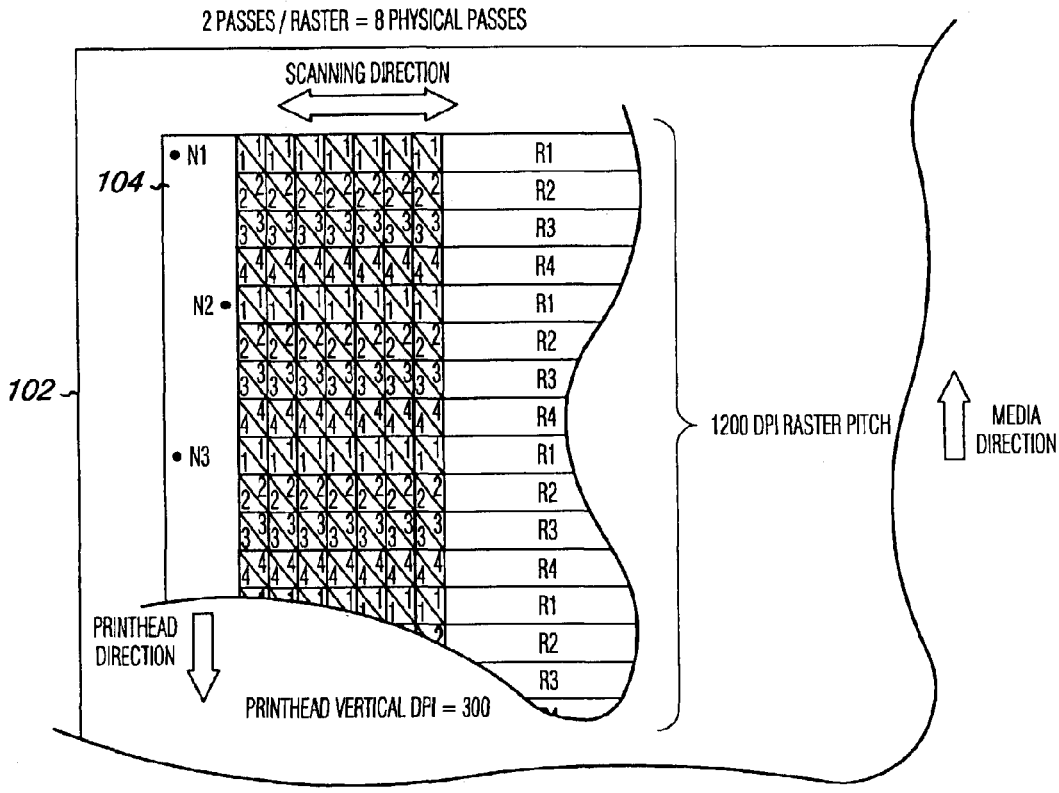
Figure 1C:
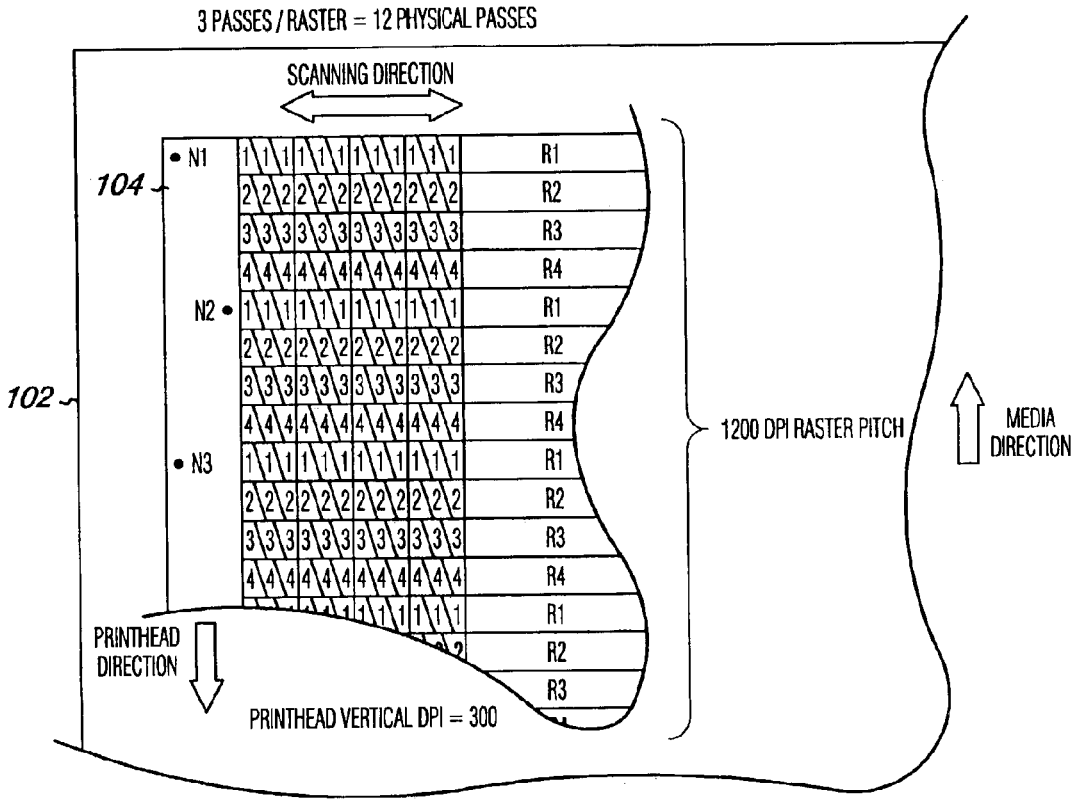

FIGS. 1A–1C illustrates printing approaches using a single print mode in a region. For illustration purposes, a particular print job example is used. In this example, a 300 vertical DPI printhead, or pen 104, is to print a data resolution of 1200 vertical rasters on a print media 102. It is noted that for a printhead resolution of 300 vertical DPI, a minimum of four physical raster passes per nozzle, e.g. nozzles N1, N2, and N3, are used to print all of the rasters, shown as rasters R1, R2, R3, and R4. That is, for a 1200 DPI vertical data resolution four raster passes per nozzle are the minimum number of raster passes used to print each raster once, e.g. 1200/300=4, in the vertical direction.

For the print mode algorithms, shown in FIGS. 1A–1C, the number of rasters are printed using an integer multiple of the minimum number of raster passes needed to print each raster once in the vertical direction. That is, an integer number, e.g. 1, 2, 3, 4, . . . , etc., of nozzle passes per horizontal raster are performed based on a "print mode" selected within a given contiguous vertical block of rasters. In this example, the minimum number of raster passes in the vertical direction is four. Thus, the integral options will result in 4, 8, 12, 16, etc., total physical passes for the region. In this example, a middle ground option is not available for selecting a print mode, with an associated speed, which would be faster than a time used to perform 8 passes, and yet would additionally provide an image quality (IQ) and/or resolution above what is achieved in 4 passes.

FIG. 1A illustrates an existing print mode where each raster, R1, R2, R3, and R4, is printed once. That is, for the above print job example one complete raster pass, on each of four different rasters, is performed in order for the 300 vertical DPI pen to print 1200 vertical rasters. This is illustrated with a single number at each pixel location on the media 102 for each respective raster, e.g. single 1's in R1, single 2's in R2, etc. Four different raster passes by each particular nozzle, e.g. N1, N2, N3, . . . , N4, in the vertical direction are made to achieve the vertical data resolution.

FIG. 1B illustrates another printing approach using a single print mode which is an integer multiple of the minimum number of raster passes used to print each raster once is chosen. In the embodiment of FIG. 1B, the integer multiple 2 is chosen for a given contiguous vertical block of rasters (e.g. as illustrated in connection with FIG. 5). Thus, each raster, R1, R2, R3, and R4, has two complete passes made over it. Alternatively stated, there are two passes by each particular nozzle, e.g. N1, N2, and N3, over each raster. This is illustrated with two numbers at each pixel location on the media 102 for each respective raster, e.g. two 1's in R1, two 2's in R2, two 3's in R3, and two 4's in R4. In this example, two passes on each of the four different raster by each particular nozzle, e.g. N1, N2, N3, . . . , N4, are performed for a total eight complete passes over four raster lines. While the vertical data resolution and an increased horizontal data resolution can be achieved in this example, the added number of passes comes at a cost of speed and print throughput.

FIG. 1C illustrates another printing approach using a single print mode which is an integer multiple of the minimum number of raster passes used to print each raster once is chosen. In the embodiment of FIG. 1C, the integer multiple 3 is chosen for a given contiguous vertical block of rasters (e.g. as illustrated in connection with FIG. 5). Thus, each raster, R1, R2, R3, and R4, has three complete passes made over it. This is illustrated with three numbers at each pixel location on the media 102 for each respective raster, e.g. three 1's in R1, three 2's in R2, three 3's in R3, and three 4's in R4. In this example, twelve different raster passes by each particular nozzle, e.g. N1, N2, and N3, are used to achieve the vertical data resolution in a given contiguous vertical block of rasters. Here again, while the vertical data resolution is achieved and an increased horizontal data resolution can be realized in this example, the added number of passes comes at a cost of speed and print throughput.

Figure 2A:
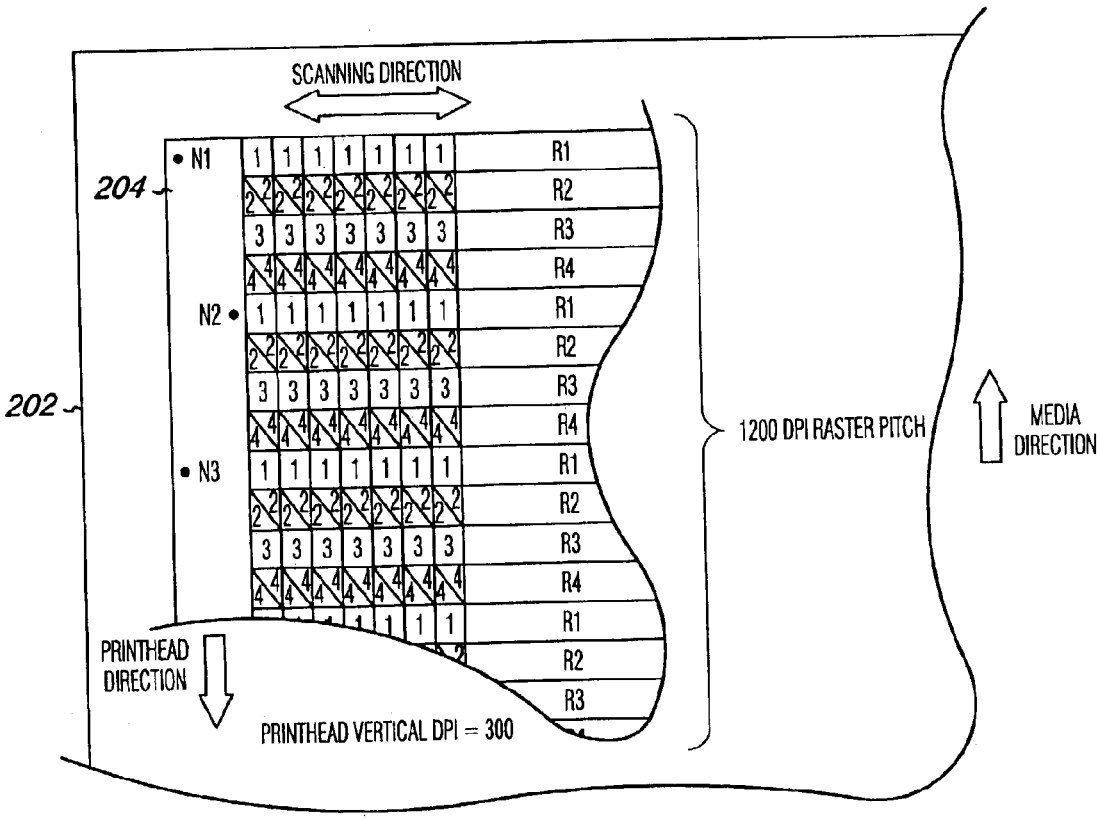
FIGS. 2A and 2B illustrate embodiments of non-uniform passes per raster (NUPR).
Figure 2B:
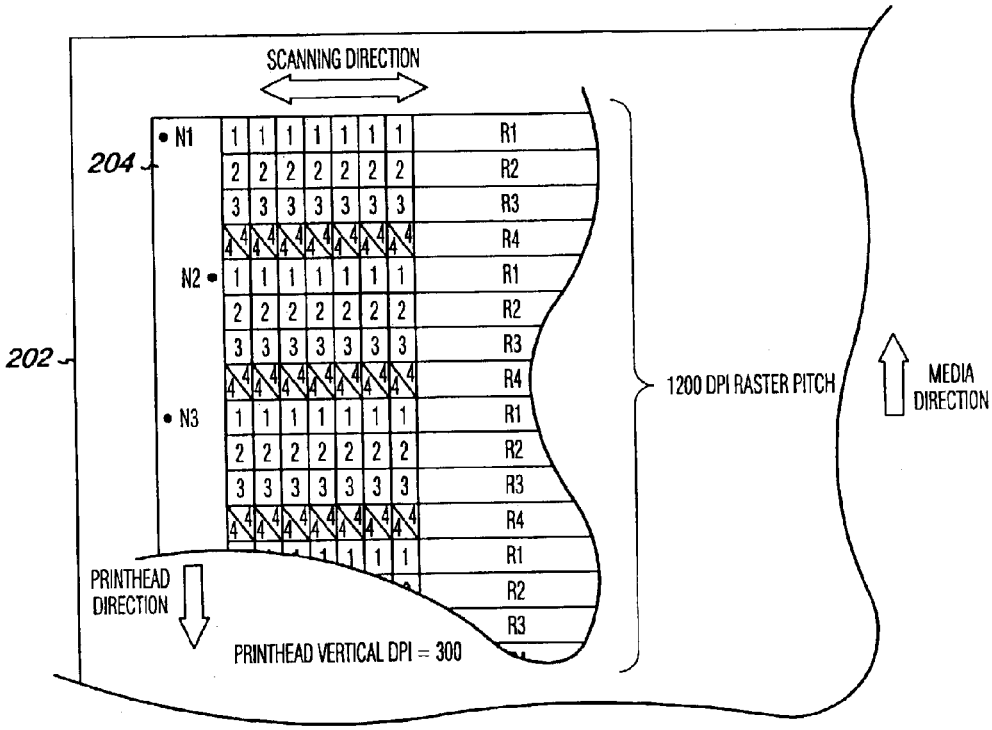

FIGS. 2A and 2B illustrate print mode embodiments for non-uniform passes per raster (NUPR). NUPR are made over a contiguous vertical blocks of rasters on print media 202 by nozzles, N1, N2, and N3, of the printhead 204. By using NUPR, many other options for print throughput are possible. The NUPR embodiments can afford faster printing than the fixed print mode algorithms described in FIGS. 1A–1C yet still obtain a desired media/image quality combination. The various embodiments allow for printing a number of raster passes, in a contiguous vertical blocks of rasters or region, using a non-integer multiple of a minimum number of raster passes used to print each raster once.

According to print mode embodiments using NUPR, non-integer multiples of the minimum number of raster passes used to print each raster once, e.g. 5, 6, 7, 9, 10, 11, 13, . . . , etc., can now be realized. FIGS. 2A and 2B provide examples to illustrate. The invention is not limited to these two particular examples.

As one of ordinary skill the art will understand, the embodiments can be performed by software, application modules, and computer executable instructions operable on the systems and devices shown herein or otherwise. The embodiments, however, are not limited to any particular operating environment or to software written in a particular programming language. Software, application modules and/or computer executable instructions, suitable for carrying out embodiments of the present invention, can be resident in one or more devices or locations or in several and even many locations.

FIG. 2A illustrates an embodiment of a 6 pass print mode in connection with a print job using a 300 vertical DPI inkjet printhead, or pen, to print 1200 vertical rasters. It was noted above that the data vertical DPI divided by the printhead vertical DPI meant that 4 physical passes would be used in this example to print all the rasters at least once.

In the embodiment of FIG. 2A, an approach is illustrated in which "odd" rasters, R1 and R3, get 1 physical nozzle pass over a complete raster, and "even" rasters, R2 and R4, get 2 physical nozzle passes over the complete raster all within a contiguous vertical block of rasters, or single region. This is illustrated with a single number at each pixel location on the media 202 for rasters R1 and R3, e.g. single 1's in R1 and single 3's in R3. In rasters R2 and R4, this is illustrated with two numbers at each pixel location on the media 202, e.g. two 2's in R2 and two 4's in R4. As a result of the non-integer multiple of the minimum number of raster passes used to print each raster once being available, a middle ground option for image quality and print throughput is achieved over existing print mode settings. That is, for example, a print mode (speed) faster than 8 passes, but with better image quality (IQ) and/or resolution than 4 passes is possible.

FIG. 2B illustrates an embodiment of a 5 pass mode for the above described print job. The 5 pass mode embodiment of FIG. 2B represents another variant of NUPR in which a non-integer multiple of the minimum number of raster passes used to print each raster once is completed for a contiguous vertical block of rasters, or single region. In the embodiment of FIG. 2B, rasters, R1, R2 and R3, receive 1 complete physical nozzle pass over each respective raster by nozzles N1, N2, and N3, and raster R4, receives 2 complete physical nozzle passes over the raster all within a single region, or contiguous vertical block of rasters R1–R4.

In FIG. 2B, this is illustrated with a single number at each pixel location on the media 202 for rasters R1, R2 and R3, e.g. single 1's in R1, single 2's in R2, and single 3's in R3. In raster R4, this is illustrated with two numbers at each pixel location on the media 202, e.g. two 4's in R4. As FIG. 2B illustrates, IQ and speed are not constrained to printing only integer multiples of the minimum number of raster passes used to print each raster in a contiguous vertical block of rasters once. In this example, a print mode other than 4, 8, 12, 16, . . . , etc. total passes are achievable within a contiguous vertical block of rasters.

As such, various embodiments for a NUPR mode can be considerably faster, e.g. greater throughput, than the existing approach described in connection with FIGS. 1A–1C. Embodiments of the invention thus allow for the print mode solution/design space to be increased. Print mode possibilities outside of the options discussed in FIGS. 1A–1C are afforded to achieve faster printing while allowing for finer granularity in the choice of speed versus IQ. Due to increased design space, chances are enhanced that a faster print mode can be found that still accords with IQ and resolution goals.

Figure 3:
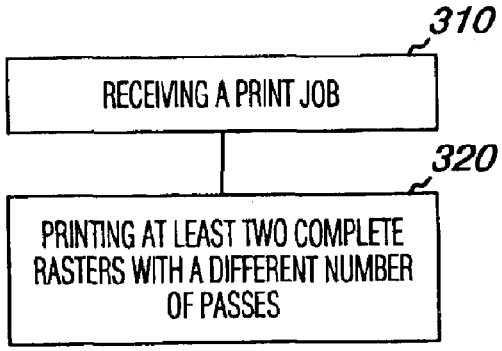
FIG. 3 illustrates a method embodiment for printing.
Figure 4:
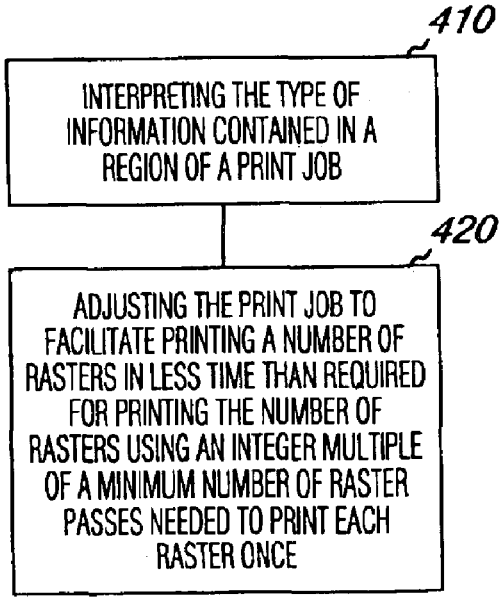
FIG. 4 illustrates a method embodiment for non-uniform passes per raster printing.

FIGS. 3 and 4 illustrate various method embodiments which provide for printing a vertical contiguous block of rasters with non-uniform passes per raster, e.g. number of physical nozzle passes per horizontal raster. According to various embodiments, described herein, non-uniform passes per raster (NUPR) accommodate a faster print mode than pre-set alternatives yet still obtain a desired media/quality print mode combination. Intermediate speed/image quality (IQ) balances are realized using modes that have non-uniform passes per raster within a contiguous vertical block of rasters and the print mode design space in multiple pass print modes can be increased.

Unless explicitly stated, the method embodiments described herein are not constrained to a particular order or sequence. Additionally, some of the described method embodiments can occur or be performed at the same point in time.

In the embodiment of FIG. 3, a method for printing images is provided. The method includes receiving a print job, as shown in block 310. The method includes performing the print job. According to the method, performing the print job includes printing non-uniform passes per raster in a contiguous vertical block of rasters.

As shown in block 320, the method includes printing at least two complete rasters, in a contiguous vertical block of rasters, where each raster is printed using a different number of physical passes. Thus, printing non-uniform passes per raster includes printing a first raster with a first number of complete passes and printing a second raster with a second number of complete passes. In various embodiments, printing a first raster with a first number of passes and printing a second raster with a second number of passes includes printing the first raster and the second raster at a in less time than would be used to print each raster using the second number of passes. In various embodiments, printing a first raster with a first number of passes and printing a second raster with a second number of passes includes printing the first raster and the second raster in less time than would be used to print the number of rasters using an integer multiple of a minimum number of raster passes, in the vertical direction, used to print each raster once.

In the embodiment of FIG. 4, a method for non-uniform passes per raster in a contiguous vertical block of rasters is provided. The method includes interpreting a print job instruction set. According to the embodiment of FIG. 4, this includes interpreting the type of information contained in a region of a print job, e.g. within a contiguous vertical block of rasters, as shown in block 410. Interpreting the type of information contained in a region of a print job includes interpreting data resolution and print mode settings.

The method includes modifying the print job instruction set to print non-uniform passes per raster in a contiguous vertical block of rasters. As shown in block 420, modifying includes adjusting the print job to facilitate printing a number of rasters in less time than would be used for printing the number of rasters using an integer multiple of a minimum number of raster passes used to print each raster once. In various embodiments, this includes printing at least two complete rasters using a different number of passes per raster.

Thus, modifying the print job instruction set to print non-uniform passes per raster includes printing a first raster with a first number of complete passes and printing a second raster with a second number of complete passes. The number of rasters printed in a contiguous vertical block of rasters is a non-integer multiple of the minimum number of raster passes used to print each raster once in the vertical direction.

In various embodiments, modifying the print job instruction set to print non-uniform passes per raster can include printing a third raster with a third number of complete passes and printing a fourth raster with a fourth number of complete passes. Printing a third raster with a third number of passes and printing a fourth raster with a fourth number of passes includes a third and a fourth number of passes which are different from the first and the second number of passes. According to the various embodiments, the number of passes in any given raster can be varied to achieve printing any non-integer multiple of a minimum number of raster passes used to print each raster once.

Figure 5:
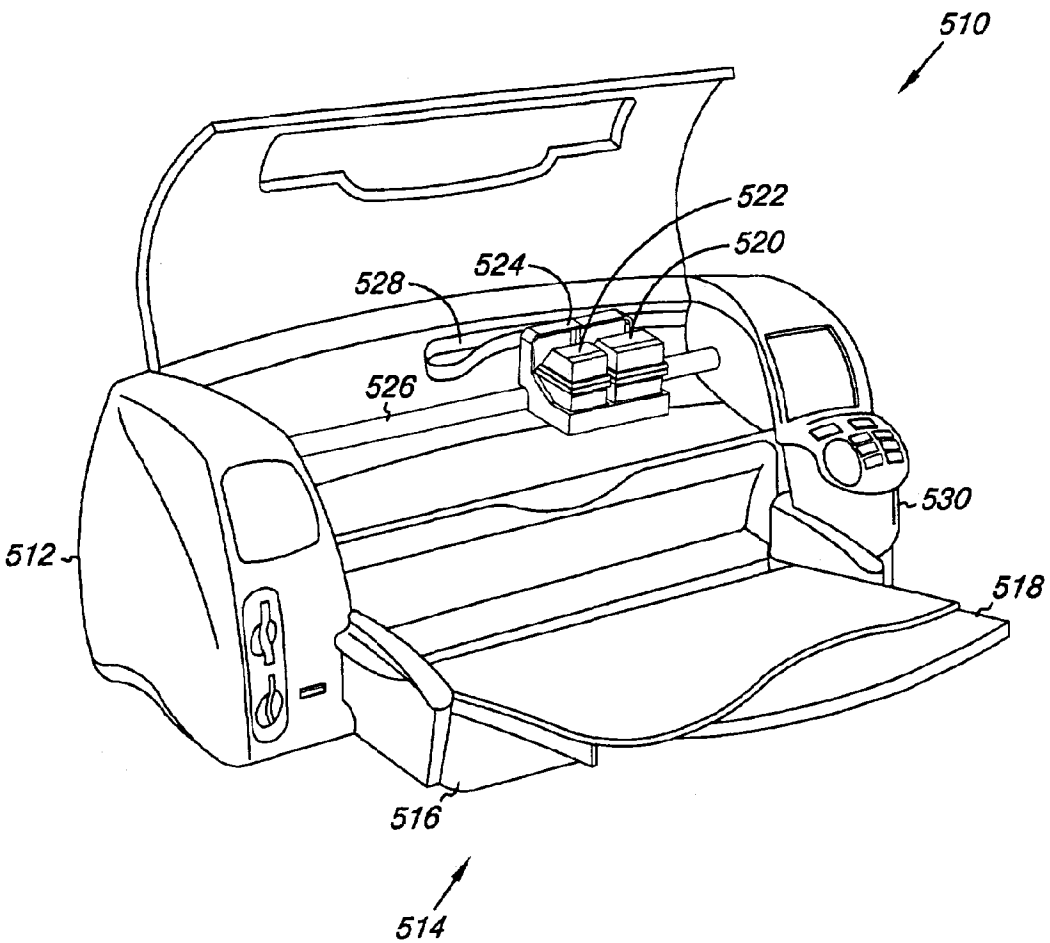
FIG. 5 illustrates a printing device with which embodiments can be implemented.

FIG. 5 provides a perspective illustration of an embodiment of a printing device which is operable to implement or which can include embodiments of the present invention. The embodiment of FIG. 5 illustrates an inkjet printer 510, which can be used in an office or home environment for business reports, correspondence, desktop publishing, pictures and the like. However, the invention is not so limited and can include other printers implementing various embodiments of the present invention. In the embodiment of FIG. 5, the printer 510 includes a chassis 512 and a print media handling system 514 for supplying one or more print media, such as a sheet of paper, business card, envelope, or high quality photo paper to the printer 510. The print media can include any type of material suitable for receiving an image, such as paper card-stock, transparencies, and the like.

In the embodiment of FIG. 5, the print media handling system 514 includes a feed tray 516, an output tray 518, and a printer drum or platen and rollers (not shown) for delivering sheets of print media into position for receiving ink from one or more inkjet printhead cartridges, shown in FIG. 5 as 520 and 522. In the embodiment of FIG. 5, inkjet printhead cartridge 520 can be a multi-color ink printhead cartridge and inkjet printhead cartridge 522 can be a black ink printhead cartridge.

As shown in the embodiment of FIG. 5, the ink printhead cartridges 520 and 522 are transported by a carriage 524. The carriage 524 can be driven along a guide rod 526 by a drive belt/pulley and motor arrangement (not shown). The actual printhead type and motor control arrangement can vary among printing devices.

Figure 6:
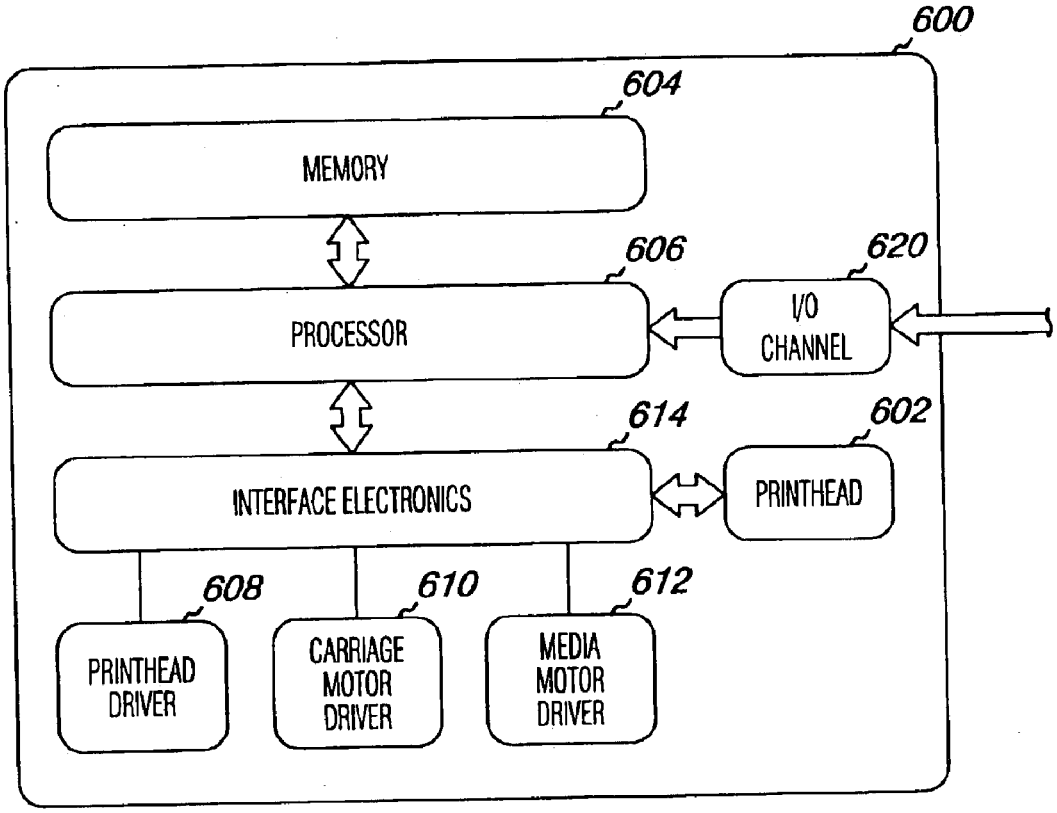
FIG. 6 illustrates an embodiment of the electronic components associated with a printer.

In the embodiment of FIG. 5, the printhead cartridges 520 and 522 selectively deposit ink droplets on a sheet of paper or other print media in accordance with instructions received via a conductor strip 528 from a printer controller 530 which can be located within chassis 512. The controller 530 receives a set of print instructions from a print driver. A print driver can reside in a computing device, such as a desktop, laptop, and the like, coupled to the printing device 510 via a network and can also reside in the printing device 510. FIG. 6 illustrates an embodiment of the electronic components associated with a printer 600, such as printer 502 in FIG. 5. As shown in FIG. 6, the printer 600 includes a printhead 602. Each printhead has multiple nozzles (shown in FIG. 7). Printer 600 includes control logic in the form of executable instructions which can exist with a memory 604 and be operated on by a controller or processor 606. The processor 606 is operable to read and execute computer executable instructions received from memory 604. The executable instructions carry out various control steps and functions for a printer. The executable instructions are operable to perform the embodiments described herein. Memory 604 can include some combination of ROM, dynamic RAM, and/or some type of nonvolatile and writeable memory such as battery-backed memory or flash memory.

FIG. 6 illustrates a printhead driver 608, a carriage motor driver 610, and a media motor driver 612 coupled to interface electronics 614 for moving the printhead 602 and media, and for firing individual nozzles. The printhead driver 608, the carriage motor driver 610, and the media motor driver 612 can be independent components or combined on one or more application specific integrated circuits (ASICs). The embodiments, however, are not so limited. Computer executable instructions, or routines, can be executed by these components. As shown in the embodiment of FIG. 6, the interface electronics 614 interface between control logic components and the electromechanical components of the printer such as the printhead 602.

Figure 9:
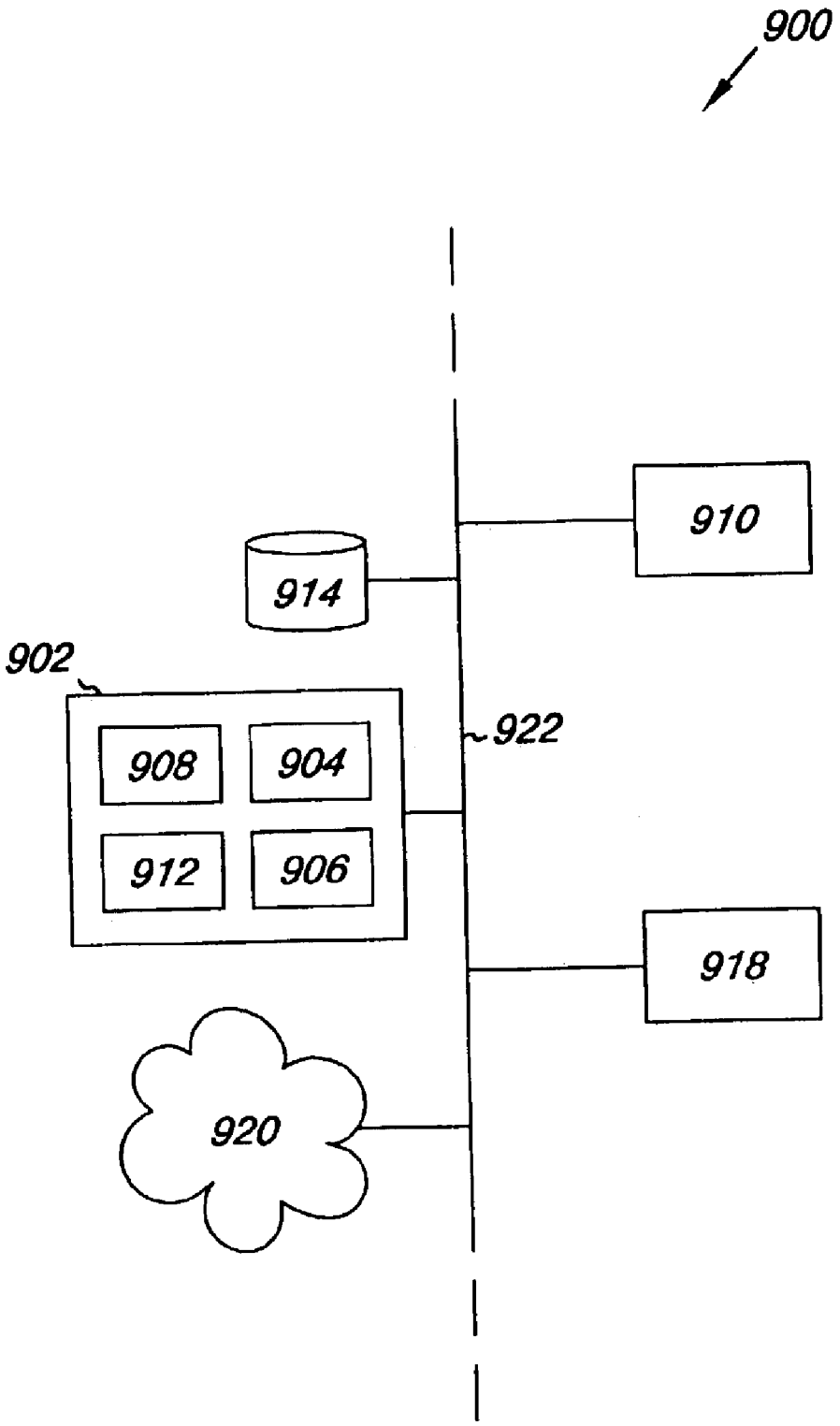
FIG. 9 illustrates a system or network environment in which embodiments can be implemented.

The processor 606 can be interfaced, or connected, to receive instructions and data from a remote device (e.g. host computer), such as 910 shown in FIG. 9, through one or more I/O channels or ports 620. I/O channel 620 can include a parallel or serial communications port, and/or a wireless interface for receiving information, e.g. print job data.

Figure 7:
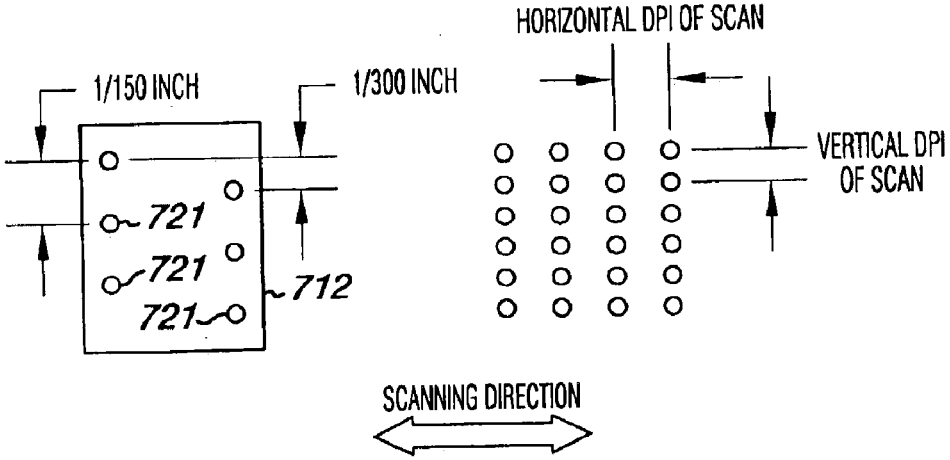
FIG. 7 illustrates an embodiment of a printhead.

FIG. 7 illustrates an embodiment of a printhead 712 which can serve as the printhead 602 shown in FIG. 6. As shown in the embodiment of FIG. 7, the printhead 712 includes a layout of nozzles 721. Printhead 712 can have one or more laterally spaced nozzle or dot columns. Each nozzle 721 is positioned at a different vertical position (where the vertical direction is the direction of print media travel, at a right angle to the direction of printhead travel, e.g. scanning direction), and corresponds to a respective pixel row on the underlying print media.

Many different printhead configurations are possible, and the embodiments of the invention are not limited to the example shown in FIG. 7. For example, in one embodiment a printhead can have nozzles corresponding to 300 pixel rows. Also, some printheads utilize redundant columns of nozzles for various purposes. A printhead can have an arrangement of 300 nozzles in a vertical column or may have 150 in one vertical column and another 150 offset in a second vertical column. In this example, the nozzles can be spaced at 1/300th of an inch such that the printhead is referred to as having a printhead vertical resolution of 300 DPI (dots per inch) or a 300 DPI packing density. A certain width strip of the media corresponding to the layout of the nozzle arrangement, can be printed during each scan of the printhead. FIG. 7, illustrates the distinction between a printed horizontal DPI of a scan.

Color printers typically have three or more sets of printhead nozzles positioned to apply ink droplets of different colors on the same pixel rows. In various embodiments the sets of nozzles can be contained within a single printhead, or incorporated in three different printheads, e.g. one each for cyan, magenta, and yellow. The principles of the invention described herein apply in either case.

The printhead 712 is responsive to the control logic implemented by a controller and memory, e.g. 614 and 615 in FIG. 6, to pass repeatedly across a print media. The individual nozzles of a given printhead are fired repeatedly during each printhead scan to apply an ink pattern to a print media. The printhead can make multiple passes over the print media to fully print all of the pixels, achieve a particular resolution, and/or achieve a certain image quality (IQ) depending on the type of information (resolution data, print mode, etc.) contained in a region, e.g. within a contiguous vertical block of rasters. In the various embodiments, the printhead 712 is responsive to the control logic implemented by a controller and memory, e.g. 614 and 615 in FIG. 6 to make physical passes which are a non-integer multiple of the minimum number of raster passes used to print each raster once within a contiguous vertical block of rasters.

FIG. 8 illustrates an embodiment of a document separated into contiguous print regions. In the embodiment of FIG. 8, it is noted that a contiguous print region typically has a blank space above and a blank space below in a direction orthogonal to a scan direction. In the embodiment of FIG. 8, input data representing the text and graphics to be printed on a piece of print media 802 are operated on by computer executable instructions to define one or more separate contiguous print regions, 804-1, . . . , 804-N. The contiguous print regions contain contiguous vertical blocks of rasters. In the various embodiments, contiguous vertical blocks of rasters can be printed using a non-integer multiple of the minimum number of raster passes used to print each raster once.

FIG. 9 illustrates that a printing device, including the embodiments described herein, can be incorporated as part of a system 900. Thus, FIG. 9 illustrates a printing device 902, such as an inkjet printer. The printing device 902 is operable to print onto print media, substrates, and surfaces of various nature.

The printing device 902 is operable to receive data and interpret the data to position an image in a particular image position. The system 900 can include software and/or application modules thereon for receiving and interpreting data in order to achieve the positioning and/or formatting functions. As one of ordinary skill in the art will appreciate, the software and/or application modules can be located on any device that is directly or indirectly connected to the printing device 902 within the system 900.

In various embodiments, including the embodiment shown in FIG. 9, the printing device 902 can include a controller 904 and a memory 906 such as the controller and memory discussed in connection with FIG. 6. The controller 904 and memory 906 are operable to implement the method embodiments described herein. In the various embodiments, the memory 906 includes memory 906 on which data, including computer readable instructions, and other information of the like can reside.

In the embodiment shown in FIG. 9, the printing device 902 can include a printing device driver 908 and a print engine 912. In various embodiments of FIG. 9, additional printing device drivers can be located off the printing device, for example, on a remote device 910. Such printing device drivers can be an alternative to the printing device driver 908 located on the printing device 902 or provided in addition to the printing device driver 908. As one of ordinary skill in the art will understand, a printing device driver 908 is operable to create a computer readable instruction set for a print job utilized for rendering an image by the print engine 912. Printing device driver 908 includes any printing device driver suitable for carrying out various aspects of the present invention. That is, the printing device driver can take data from one or more software applications and transform the data into a print job.

When a printing device is to be utilized to print an image on a piece of print media, a print job can be created that provides instructions on how to print the image. These instructions are communicated in a Page Description Language (PDL) to initiate a print job. The PDL can include a list of printing properties for the print job. Printing properties include, by way of example and not by way of limitation, the size of the image to be printed, its positioning on the print media, resolution data of a print image (e.g. DPI), color settings, simplex or duplex setting, indications to process image enhancing algorithms (e.g. halftoning), and the like.

As shown in the embodiment of FIG. 9, printing device 902 can be networked to one or more remote devices 910 over a number of data links, shown as 922. As one of ordinary skill in the art will appreciate upon reading this disclosure, the number of data links 922 can include one or more physical and one or more wireless connections, including but not limited to electrical, optical, and RF connections, and any combination thereof, as part of a network. That is, the printing device 902 and the one or more remote devices 910 can be directly connected and can be connected as part of a wider network having a plurality of data links 922.

In various embodiments, a remote device 910 can include a device having a display such as a desktop computer, laptop computer, a workstation, hand held device, or other device as the same will be known and understood by one of ordinary skill in the art. The remote device 910 can also include one or more processors and/or application modules suitable for running software and can include one or more memory devices thereon.

As shown in the embodiment of FIG. 9, a system 900 can include one or more networked storage devices 914, e.g. remote storage database and the like, networked to the system. Likewise, the system 900 can include one or more peripheral devices 918, and one or more Internet connections 920, distributed within the network.

Memory, such as memory 906 and memory 914, can be distributed anywhere throughout a networked system. Memory, as the same is used herein, can include any suitable memory for implementing the various embodiments of the invention. Thus, memory and memory devices include fixed memory and portable memory. Examples of memory types include Non-Volatile (NV) memory (e.g. Flash memory), RAM, ROM, magnetic media, and optically read media and includes such physical formats as memory cards, memory sticks, memory keys, CDs, DVDs, hard disks, and floppy disks, to name a few.

The system embodiment 900 of FIG. 9 includes one or more peripheral devices 918. Peripheral devices can include any number of peripheral devices in addition to those already mentioned herein. Examples of peripheral devices include, but are not limited to, scanning devices, faxing devices, copying devices, modem devices, and the like.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature of the technical disclosure. It is submitted with the understanding that it will not be used to limit the scope of the claims.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A printing method for printing, comprising:

receiving a print job; and performing the print job, wherein performing the print job includes printing a number of raster passes which is a non-integer multiple of a minimum number of raster passes used to print each raster once.

2. The method of claim 1, wherein printing a number of raster passes which is a non-integer multiple of a minimum number of raster passes used to print each raster once includes printing non-uniform passes per raster in a contiguous vertical block of rasters.

3. The medium of claim 2, wherein printing non-uniform passes per raster in a contiguous vertical block of rasters includes printing a first raster and a second raster in less time than would be used to print each raster pass with the second number of passes.

4. A method for non-uniform passes per raster printing, comprising:

interpreting a print job instruction set; and modifying the print job instruction set to print a number of raster passes which is a non-integer multiple of a minimum number of raster passes used to print each raster once.

5. The method of claim 4, wherein modifying the print job instruction set to print a number of raster passes which is a non-integer multiple of a minimum number of raster passes used to print each raster once includes printing a non-uniform number of complete passes per raster including, printing a first raster in the region with a first number of passes and printing a second raster in the region with a second number of passes.

6. The method of claim 5, wherein printing a non-uniform number of complete passes per raster further includes printing a third raster with a third number of passes and printing a fourth raster with a fourth number of passes.

7. The method of claim 6, wherein printing a third raster with a third number of passes and printing a fourth raster with a fourth number of passes includes printing with a third and a fourth number of passes which are different from the first and the second number of passes.

8. A computer readable medium having a set of executable instructions for causing a device to perform a method, comprising:

interpreting the type of information contained in a region of a print job; and adjusting the print job to facilitate printing a number of rasters using a non-integer multiple of a minimum number of raster passes used to print each raster once.

9. The medium of claim 8, wherein interpreting the type of information contained in a region of a print job includes interpreting resolution data and print mode settings.

10. The medium of claim 8, wherein adjusting the print job to facilitate printing a number of rasters using a non-integer multiple of a minimum number of raster passes used to print each raster once includes printing a first raster with a first number of complete passes and printing a second raster with a second number of complete passes.

11. The medium of claim 8, wherein adjusting the print job to facilitate printing a number of rasters using a non-integer multiple of a minimum number of raster passes used to print each raster once includes printing at least two complete rasters with a different number of passes within a contiguous vertical block of rasters.

12. An apparatus, comprising:

a controller;

a printhead coupled to the controller; and a printhead driver operable to interface instructions from the controller to the printhead, wherein the instructions include instructions to cause the printhead to perform, a non-integer multiple of a minimum number of raster passes used to print each raster once in a vertical direction.

13. The apparatus of claim 12, wherein the instructions include instructions to print at least two complete rasters with a different number of passes.

14. The apparatus of claim 12, wherein the instructions include instructions to print a first raster with a first number of complete passes and to print a second consecutive raster with a second number of complete passes.

15. The apparatus of claim 14, wherein the instructions are operable to print the first raster and the second raster using non-uniform passes between rasters in a contiguous vertical block of rasters.

16. A printing device, comprising:

a printhead; and means for controlling the printhead to perform non-integer, complete pass multiples of a minimum number of raster passes used to print each raster once.

17. The device of claim 16, wherein the means includes a controller interfaced with one or more printhead driver electronics to control the printhead.

18. The device of claim 16, the means includes a set of computer executable instructions operable to cause the device to print a first raster with a first number of complete passes and to print a second raster with a second number of complete passes within the contiguous vertical block of rasters.

19. The device of claim 18, wherein the means includes a set of computer executable instructions operable to cause the device to print the first raster and the second raster at a non-uniform, complete pass per raster in a contiguous vertical block of rasters.

20. A printing device, comprising:

a printhead driver;

a carriage motor driver;

a media motor driver;

a processor;

a printhead;

wherein the printhead driver, the carriage motor driver, the media motor driver, the processor, and the printhead are coupled via interface electronics for moving the printhead and media, and for firing individual nozzles of the printhead; and wherein the printhead driver is operable to interface an instruction set from the processor to the printhead, wherein the instruction set includes instructions to cause the printhead to perform a non-integer multiple of a minimum number of raster passes used to print each raster once.

21. An imaging system, comprising:

a remote device have at least one application operable to create a print job; and a printing device operable to receive the print job from the remote device, wherein the printing device includes;

a processor;

a printhead coupled to the processor; and a printhead driver operable to interface instructions from the processor to the printhead, wherein the instructions include instructions to cause the printhead to perform a non-integer multiple of a minimum number of raster passes used to print each raster once.

22. The system of claim 21, wherein the instructions include instructions operable to cause the device to print a first raster and a second raster at a non-integer, complete pass multiple of a minimum number of raster passes used to print each raster once.

* * * * *